United States Patent [19]

Yagi et al.

[11] 4,086,889

[45] May 2, 1978

[54] ELECTROMAGNETIC SELECTOR VALVE SYSTEM

[75] Inventors: Touru Yagi, Musashino; Hiroyuki Osawa, Saitama, both of Japan

[73] Assignee: Honda Giken Kogyo Kabushiki Kaisha, Tokyo, Japan

[21] Appl. No.: 709,799

[22] Filed: Jul. 29, 1976

[30] Foreign Application Priority Data

| | | |
|---|---|---|
| Aug. 5, 1975 | Japan | 50-107822 |
| Nov. 26, 1975 | Japan | 50-159259 |

[51] Int. Cl.[2] ..... F02P 5/04

[52] U.S. Cl. ..... 123/117 A; 137/596.17; 123/117 R

[58] Field of Search ..... 123/117 A, 117 R; 137/596.17

[56] References Cited

U.S. PATENT DOCUMENTS

| | | | |
|---|---|---|---|
| 3,040,775 | 6/1962 | Ray | 137/596.17 |
| 3,559,666 | 2/1971 | Walker et al. | 123/117 A |
| 3,752,128 | 8/1973 | Tatsutomi et al. | 123/117 A |
| 3,783,846 | 1/1974 | Barnhart et al. | 123/117 A |
| 3,823,736 | 7/1974 | Vanti | 137/596.17 |

FOREIGN PATENT DOCUMENTS

| | | | |
|---|---|---|---|
| 532,533 | 8/1955 | Italy | 137/596.17 |
| 840,439 | 7/1960 | United Kingdom | 137/596.17 |

*Primary Examiner*—Charles J. Myhre
*Assistant Examiner*—Parshotam S. Lall
*Attorney, Agent, or Firm*—Lyon & Lyon

[57] ABSTRACT

An electromagnetic selector valve system having an electrically conductive coil adjacent a moveable core within a valve body. First, second and third valve passages are in communication with the valve body, and biasing means are adapted to bias the reciprocative core to assume a first position wherein the core permits communication only between the first and third passages. Upon energizing the electrically conductive coil, the core assumes a second position which permits communication only between the first and second passages. In a preferred embodiment, the electromagnetic selector valve is utilized in order to control the spark advance of an engine.

1 Claim, 4 Drawing Figures

ELECTROMAGNETIC SELECTOR VALVE SYSTEM

BACKGROUND OF THE INVENTION

1. FIELD OF THE INVENTION

The present invention is directed to an improved method and apparatus for electromagnetically selecting a valve position.

2. DESCRIPTION OF THE PRIOR ART

Existing electromagnetic selector valve systems require a separate selective valve for each operative mode. Such configurations necessitate bulky and expensive systems with complex construction.

SUMMARY OF THE INVENTION

The present invention provides an electromagnetic selector valve system having an electrically conductive coil adjacent a moveable core within a valve body. First, second and third valve passages are in communication with the valve body, and biasing means are adapted to bias the reciprocative core to assume a first position wherein the core permits communication only between the first and third passages. When utilized to control spark advance, the first passage may be placed in communication with a vacuum source in an intake passage of an engine. The second and third passages may be connected to vacuum chambers on opposite sides of a diaphragm connected to a point base of a distributor. Thus, when the first and third passages are in communication with each other and the second passage is in communication with the atmosphere the pressure will be greater on the side of the diaphragm in communication with the second passage and the distributor angle may be retarded. Similarly, when the first and second passages are in communication with each other and the third passage is in communication with the atmosphere, the pressure on the diaphragm is greater on that side of the diaphragm in communication with the third passage and the diaphragm may urge the distributor to a spark advance position.

Such a configuration may also include an ignition switch in series with the power source utilized to energize the electrically conductive core. The invention may further include high vehicle speed and low engine temperature switches connected in parallel such that if either of the switches close, indicating high vehicle speed or low engine temperature respectively, electrical current may pass from the power source through the ignition switch and the closed high vehicle speed and/or low engine temperature switch to the electrically conductive coil in order to energize the coil and urge the reciprocative core to assume the second of two predetermined positions.

DESCRIPTION OF THE PREFERRED EMBODIMENTS

Figures 1, 2, 3:
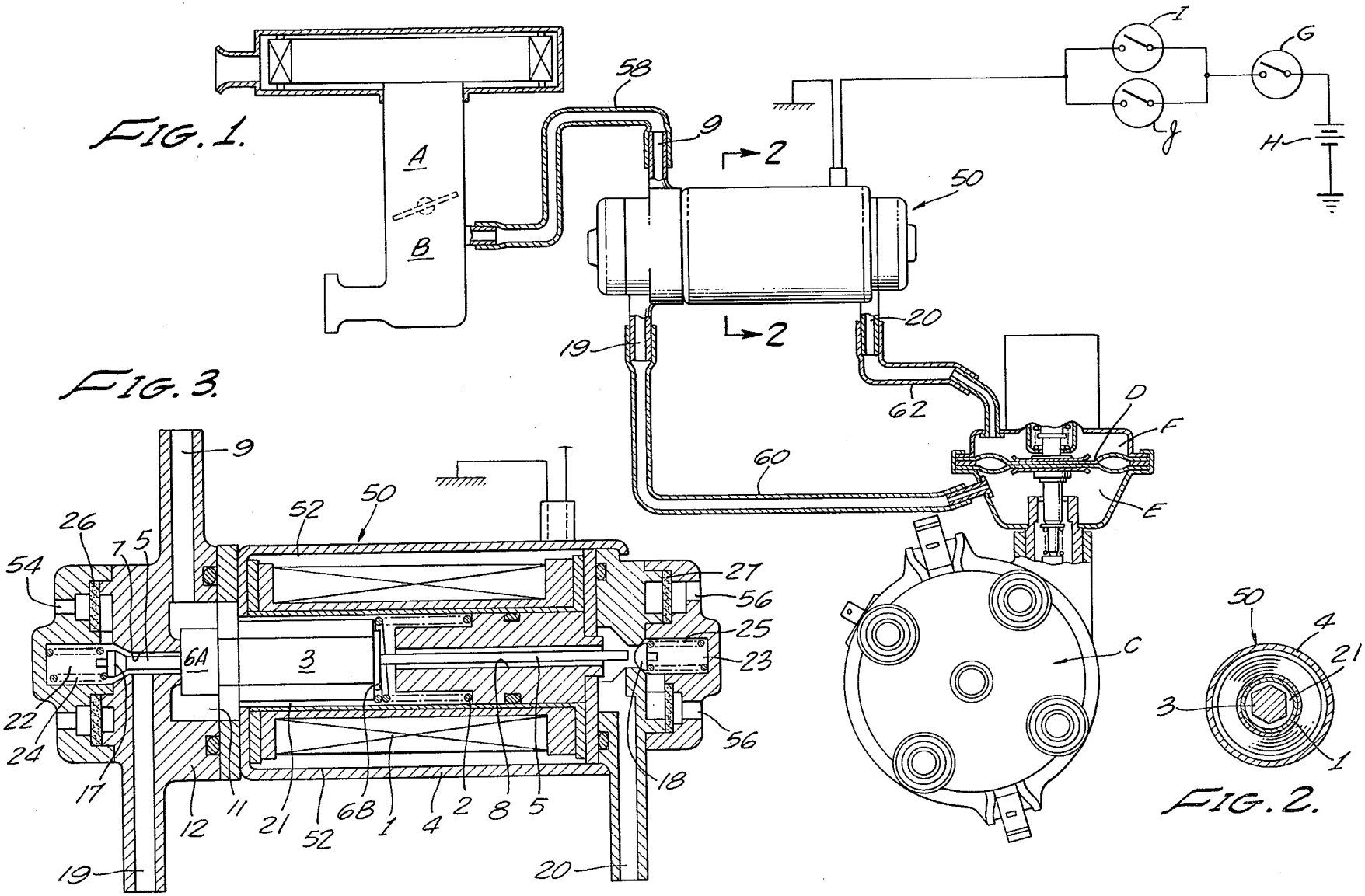
FIG. 1 is a partial cross sectional view illustrating the invention.
FIG. 2 is a cross sectional view taken about line 2—2 of FIG. 1.
FIGS. 3 and 4 are sectional views illustrating the invention.
Figure 4:
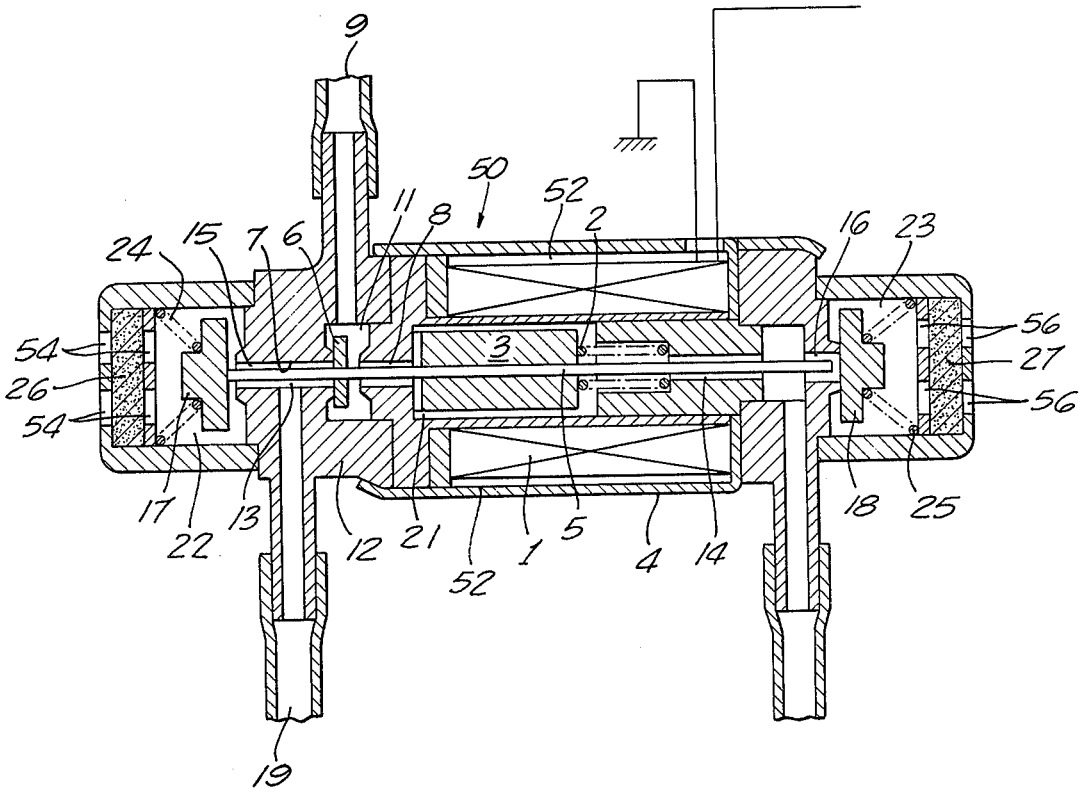

Referring now to FIG. 4, an electromagnetic selector valve system, generally referred to as 50, is shown. (FIG. 1 illustrates the electromagnetic selector valve system 50 in a preferred embodiment for controlling engine spark advance which will be discussed in detail later in this specification.) Referring again to FIG. 4, a valve body 4 defining a preferably cylindrical chamber therein is shown having an electrically conductive solenoid coil 1 positioned or wound about the inner surface or periphery 52 of the valve body 4. Positioned within the annular space formed by the solenoid coil 1 is a moveable and reciprocative core 3 which is urged to assume the position illustrated in FIG. 4 by biasing means such as a spring member 2.

A valve case member 12 is provided which houses a valve chamber 11 having a pair of opposed valve holes openings 7 and 8 to be closed selectively by a valve 6 connected to the core 3 by means of a rod or shaft member 5. Front and rear assembly valve holes 15 and 16 are provided on each outer end of the selector valve system 50, said valve holes 15 and 16 being connected through annular shaft holes 13 and 14 to valve holes 7 and 8 respectively. Front and rear valves 17 and 18 are disposed adjacent an extended end of the rod 5 to be opened when pushed by rod 5 upon the reciprocation or movement of the core 3. An air gap 21 is provided about the periphery of the core 3 so as to form a part of the annular shaft hole 14. Valves 17 and 18 are biased towards a position sealing valve holes 15 and 16 by means of biasing members or springs 24 and 25 which are positioned within valve cases 22 and 23 respectively. Valve cases 22 and 23 may be provided with air filters 26 and 27 respectively so as to provide a filtering medium between the valve cases 22 and 23 and the atmosphere to which the valve case is in communication by means of apertures 54 and 56 respectively.

Referring now to FIG. 1, an embodiment of the invention is shown wherein the electromagnetic selector valve system 50 is utilized in an ignition timing control application for an engine. The first passage 9 is connected to a vacuum source B in an intake passage A of an engine by means of conduit 58. Second and third passages, 19 and 20, are connected to vacuum chambers E and F respectively disposed on opposite sides of a diaphragm D by means of conduits 60 and 62. Diaphragm D is in turn connected to a distributor C. The coil 1 of the electromagnetic selector valve system is connected through an ignition switch G to a power source H. A low temperature switch J and a high velocity switch I may be positioned in parallel electrical conductive relationship between the ignition switch G and the coil 1.

Having described the structure of the invention in detail, its method of operation will now be discussed. When both switches I and J are opened, indicating vehicle speed below a predetermined high level speed necessary to close switch I and engine temperature above a predetermined low temperature necessary to close switch J, the reciprocative core 3 moves toward the left as shown in FIG. 4 so that the first passage 9 is selected for communication with the third passage 20 thereby connecting the vacuum chamber F for angle retarding to the source of vacuum B and retarding the ignition timing.

When either of the switches I or J are closed indicating vehicle speed above a predetermined level or engine temperature below a predetermined level, the reciprocal core 3 moves toward the right as shown in FIG. 4 so that the first passage 9 is in communication with the second passage 19 thereby connecting the vacuum chamber E for angle advancing to the vacuum source B and controlling the ignition timing to advance the timing.

When the first valve passage 9 is connected to the third valve passage 20, the second valve passage 19 is connected through valve hole 15 to the atmosphere so that the vacuum chamber E is held at atmospheric pressure as contrasted with the vacuum on the F side of the diaphragm D. When the first valve passage 9 is in communication with the second valve passage 19, the third valve passage 20 is connected through the valve hole 16 to the atmosphere by means of apertures 56 so that the vacuum chamber F is held at atmospheric pressure as contrasted with the vacuum on the opposite side of the diaphragm D.

Referring now more specifically to the manner in which the valve passages 9, 19 and 20 are interconnected during the operation of the electromagnetic selector valve system 50, the reciprocative or moveable core 3 normally moves toward the left as shown in FIG. 4 being biased in this direction by means of a spring 2. This movement into what may be termed a first core position causes valve 6 to close valve hole 7 and open valve hole 8. Further, the rod 5 overcomes the bias produced by spring 24 on valve 17 so as to open hole 15 to be placed in communication with the atmosphere by means of apertures 54. The opening of valve hole 15 allows atmospheric pressure to enter through apertures 54, pass through the valve hole 15 and shaft hole 13 and into the second passage 19. Further, the first passage 9 and the third passage 20 are placed in communication through the open valve hole 8, the air gap 21 and the annular shaft hole 14 about rod 5.

Upon energizing the coil 1 the core is moved towards the right as shown in FIG. 4 and valve 6 closes valve hole 8 and opens valve hole 7. Rod 5 which is connected to the core 3 is also moved toward the right in overcoming the initial bias of spring 2. This movement causes valve 17 to close valve hole 15 and further causes valve 18 to open hole 16. Thus in this configuration, the third passage 20 is in communication with the atmosphere by means of atmospheric pressure being allowed to pass through the apertures 56 of valve case 23 and into the valve hole 16 which is adjacent the third passage 20. Additionally, the first and second passages 9 and 19 are in communication following the path from the first passage 9 through the opened valve hole 7 and into the annular shaft hole 13 adjacent the second passage 19.

In a further preferred embodiment as illustrated in FIG. 3, valve holes 7 and 8 are positioned on either side of the core 3 and are sealed by valve members 6A and 6B respectively. Such a configuration is more stable in its operation, thus providing increased durability of the valve system 50. Further, the valve members 6A and 6B need only seat against a valve hole on one side of the valve member thus providing for less expensive valve manufacture and increased reliability.

As seen from the foregoing, the present invention provides a single solenoid or electrically conductive coil associated with a single core which allows a selection between two passages thus eliminating the disadvantages in the conventional systems which use two separate selector valves of electromagnetic type.

Having fully described the invention, it is to be understood that the scope of the invention is not to be limited to the details set forth but is to be in accordance with the full scope of the appended claims.

What is claimed is:

1. An electromagnetic selector valve spark timing apparatus for an engine comprising, in combination: an electrically conductive coil positioned adjacent a moveable core, said core being adapted to reciprocate between first and second predetermined positions, said coil and core being positioned within a valve body chamber; first, second and third valve passages in communication with said valve body chamber, said first passage being in communication with an engine intake manifold, said second passage being connected to a vacuum chamber for advancing the ignition timing and said third passage being connected to a vacuum chamber for retarding the ignition timing, a diaphragm separating said vacuum chambers being connected to a distributor, biasing means adapted to bias said reciprocative core to assume said first position, said core being adapted to permit communication only between said first and third passages in said first position, said core being adapted to be energized in order to cause said core to assume said second position, said core being adapted to permit communication only between said first and second passage in said second position, first and second valves are positioned at opposite ends of said reciprocative core, and said third and second valve passages are communicated to atmosphere through said first and second valves respectively when each said valve is moved by said reciprocative core to open, a power source is electrically connected to said electrically conductive coil, said source being connected in series electrical relationship with an ignition switch, a normally open high vehicle speed switch and a normally open low engine temperature switch are placed in parallel electrical connection between said power source and said coil.

* * * * *